US006968652B1

(12) United States Patent
Eadie

(10) Patent No.: US 6,968,652 B1
(45) Date of Patent: Nov. 29, 2005

(54) FLOORING DEVICE FOR POSITIONING ON JOISTS

(76) Inventor: Robert J. Eadie, 16 Alister Cir., East Northport, NY (US) 11731

( * ) Notice: Subject to any disclaimer, the term of this patent is extended or adjusted under 35 U.S.C. 154(b) by 0 days.

(21) Appl. No.: 10/335,345

(22) Filed: Dec. 31, 2002

Related U.S. Application Data

(63) Continuation-in-part of application No. 09/833,476, filed on Apr. 12, 2001, now abandoned.

(51) Int. Cl.[7] ..... E04C 2/38
(52) U.S. Cl. ..... 52/71; 52/630; 446/109
(58) Field of Search ..... 52/70, 71, 630, 52/31, 173.1, 65, 309.7, 342, 582.1, 799.1, 52/109; 181/30; 160/135; 446/1, 109, 112, 446/113, 487; 296/100.06

(56) References Cited

U.S. PATENT DOCUMENTS

| | | | | |
|---|---|---|---|---|
| 388,424 | A * | 8/1888 | Lindblad | 52/70 |
| 1,710,610 | A | 4/1929 | Duke | |
| 2,822,585 | A | 2/1958 | Baruch | |
| 2,860,383 | A * | 11/1958 | Heisler | 108/167 |
| 3,021,575 | A * | 2/1962 | Heisler | 108/167 |
| 3,280,796 | A * | 10/1966 | Hatcher | 119/499 |
| 3,466,830 | A | 9/1969 | Smith | |
| 3,566,556 | A * | 3/1971 | Nichols | 52/71 |
| 3,686,804 | A * | 8/1972 | Browne | 52/31 |
| 3,820,295 | A | 6/1974 | Folley | |
| 4,118,901 | A | 10/1978 | Johnson | |
| 4,241,555 | A * | 12/1980 | Dickens et al. | 52/454 |
| 4,599,841 | A | 7/1986 | Haid | |
| 4,736,562 | A * | 4/1988 | Kelly | 52/173.1 |
| 4,832,256 | A | 5/1989 | Grigsby | |
| 4,932,172 | A * | 6/1990 | Maas | 52/71 |
| 4,946,217 | A * | 8/1990 | Steffens et al. | 296/100.09 |
| 5,033,241 | A | 7/1991 | Max | |
| 5,132,156 | A | 7/1992 | Trassare, Jr. et al. | |
| 5,188,418 | A | 2/1993 | Walworth, Jr. et al. | |
| 5,214,885 | A * | 6/1993 | Maas et al. | 52/71 |
| 5,239,790 | A | 8/1993 | Fetzer | |
| 5,735,097 | A | 4/1998 | Cheyne | |
| 5,842,314 | A * | 12/1998 | Porter | 52/309.7 |
| D406,360 | S | 3/1999 | Finkell, Jr. | |

(Continued)

FOREIGN PATENT DOCUMENTS

| | | | | |
|---|---|---|---|---|
| GB | 2195907 A | * | 4/1988 | A63H 33/10 |

OTHER PUBLICATIONS

Sporty's, "Instant Attic Flooring," Sportman's Market, Inc. (Batavia, OH), (May 5, 2001).

*Primary Examiner*—Naoko Slack

(57) ABSTRACT

A flooring device is disclosed for positioning on joists for allowing easy maneuvering on floor joists in an attic. The flooring device includes a plurality of substantially rigid panels arranged adjacent to each other in a series. The invention also includes a connecting mechanism located at a juncture between each of the panels in the series for connecting each panel to an adjacent panel. The connecting mechanism permits adjacent panels of the series to pivot about a pivot axis with respect to each other, with the pivot axis of the mechanism at one juncture of the series being positioned adjacent to the top sides of the panel adjacent to the juncture and the pivot axis of the mechanism at an adjacent juncture being positioned adjacent to the bottom side of the panels adjacent to the juncture such that the series of panels are foldable in accordion fashion between collapsed and extended conditions.

10 Claims, 3 Drawing Sheets

U.S. PATENT DOCUMENTS 6,021,615 A 2/2000 Brown
6,058,660 A 5/2000 Melton
6,302,468 B1 * 10/2001 Steadman ..... 296/100.04
6,343,442 B1 * 2/2002 Marks ..... 52/71
2003/0192836 A1 * 10/2003 Ulrich ..... 211/20

* cited by examiner

FLOORING DEVICE FOR POSITIONING ON JOISTS

REFERENCE TO RELATED APPLICATION

This application is a continuation-in-part of application Ser. No. 09/833,476, filed Apr. 12, 2001 now abandoned.

BACKGROUND OF THE INVENTION

1. Field of the Invention

The present invention relates to flooring devices and more particularly pertains to a new flooring device for positioning on joists for allowing easy maneuvering on floor joists in an attic.

2. Description of the Prior Art

The use of flooring devices is known in the prior art. More specifically, flooring devices heretofore devised and utilized are known to consist basically of familiar, expected and obvious structural configurations, not with standing the myriad of designs encompassed by the crowded prior art which have been developed for the fulfillment of countless objectives and requirements.

Known prior art includes U.S. Pat. No. 2,822,585; U.S. Pat. No. 5,033,241; U.S. Pat. No. 1,710,610; U.S. Pat. No. 5,239,790; U.S. Pat. No. 4,599,841; U.S. Pat. No. 6,021,615; U.S. Pat. No. 5,735,097; and U.S. Des. Pat. No. 406,360.

While these devices fulfill their respective, particular objectives and requirements, the aforementioned patents do not disclose a new flooring device for positioning on joists.

In these respects, the flooring device for positioning on joists according to the present invention substantially departs from the conventional concepts and designs of the prior art, and in so doing provides an apparatus primarily developed for the purpose of allowing easy maneuvering on floor joists in an attic.

SUMMARY OF THE INVENTION

In view of the foregoing disadvantages inherent in the known types of flooring devices now present in the prior art, the present invention provides a new flooring device for positioning on joists construction wherein the same can be utilized for allowing easy maneuvering on floor joists in an attic.

The general purpose of the present invention, which will be described subsequently in greater detail, is to provide a new flooring device for positioning on joists which has many of the advantages of the flooring devices mentioned heretofore and many novel features that result in a new flooring device for positioning on joists which is not anticipated, rendered obvious, suggested, or even implied by any of the prior art flooring devices, either alone or in any combination thereof.

To attain this, the present invention generally comprises a plurality of substantially rigid panels arranged adjacent to each other in a series, with each of the panels having a top side, a bottom side, a pair of relatively shorter and opposite end edges, and a pair of relatively longer and opposite side edges. The invention also includes connecting means located at a juncture between each of the panels in the series for connecting each panel of the plurality of panels to an adjacent panel in the series. The connecting means permits adjacent panels of the series to pivot about a pivot axis with respect to each other, with the pivot axis of the connecting means at one juncture of the series of panels being positioned adjacent to the top sides of the panel adjacent to the juncture and the pivot axis of the connecting means at an adjacent juncture being positioned adjacent to the bottom side of the panels adjacent to the juncture such that the series of panels are foldable in accordion fashion between a collapsed condition and an extended condition.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new flooring device for positioning on joists which has many of the advantages of the flooring devices mentioned heretofore and many novel features that result in a new flooring device for positioning on joists which is not anticipated, rendered obvious, suggested, or even implied by any of the prior art flooring devices, either alone or in any combination thereof.

It is another object of the present invention to provide a new flooring device for positioning on joists which may be easily and efficiently manufactured and marketed.

It is a further object of the present invention to provide a new flooring device for positioning on joists which is of a durable and reliable construction.

An even further object of the present invention is to provide a new flooring device for positioning on joists which is susceptible of a low cost of manufacture with regard to both materials and labor, and which accordingly is then susceptible of low prices of sale to the consuming public, thereby making such flooring device for positioning on joists economically available to the buying public.

Still yet another object of the present invention is to provide a new flooring device for positioning on joists which provides in the apparatuses and methods of the prior art some of the advantages thereof, while simultaneously overcoming some of the disadvantages normally associated therewith.

Still another object of the present invention is to provide a new flooring device for positioning on joists for allowing easy maneuvering on floor joists in an attic.

Yet another object of the present invention is to provide a new flooring device for positioning on joists which includes a plurality of substantially rigid panels arranged adjacent to each other in a series, with each of the panels having a top side, a bottom side, a pair of relatively shorter and opposite end edges, and a pair of relatively longer and opposite side edges. The invention also includes connecting means located at a juncture between each of the panels in the series for connecting each panel of the plurality of panels to an adjacent panel in the series. The connecting means permits adjacent panels of the series to pivot about a pivot axis with respect to each other, with the pivot axis of the connecting means at one juncture of the series of panels being positioned adjacent to the top sides of the panel adjacent to the juncture and the pivot axis of the connecting means at an adjacent juncture being positioned adjacent to the bottom side of the panels adjacent to the juncture such that the series of panels are foldable in accordion fashion between a collapsed condition and an extended condition.

Still yet another object of the present invention is to provide a new flooring device for positioning on joists that is retrofitted to existing attics and other floor joists.

Even still another object of the present invention is to provide a new flooring device for positioning on joists that is foldable for easy storage and moving.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
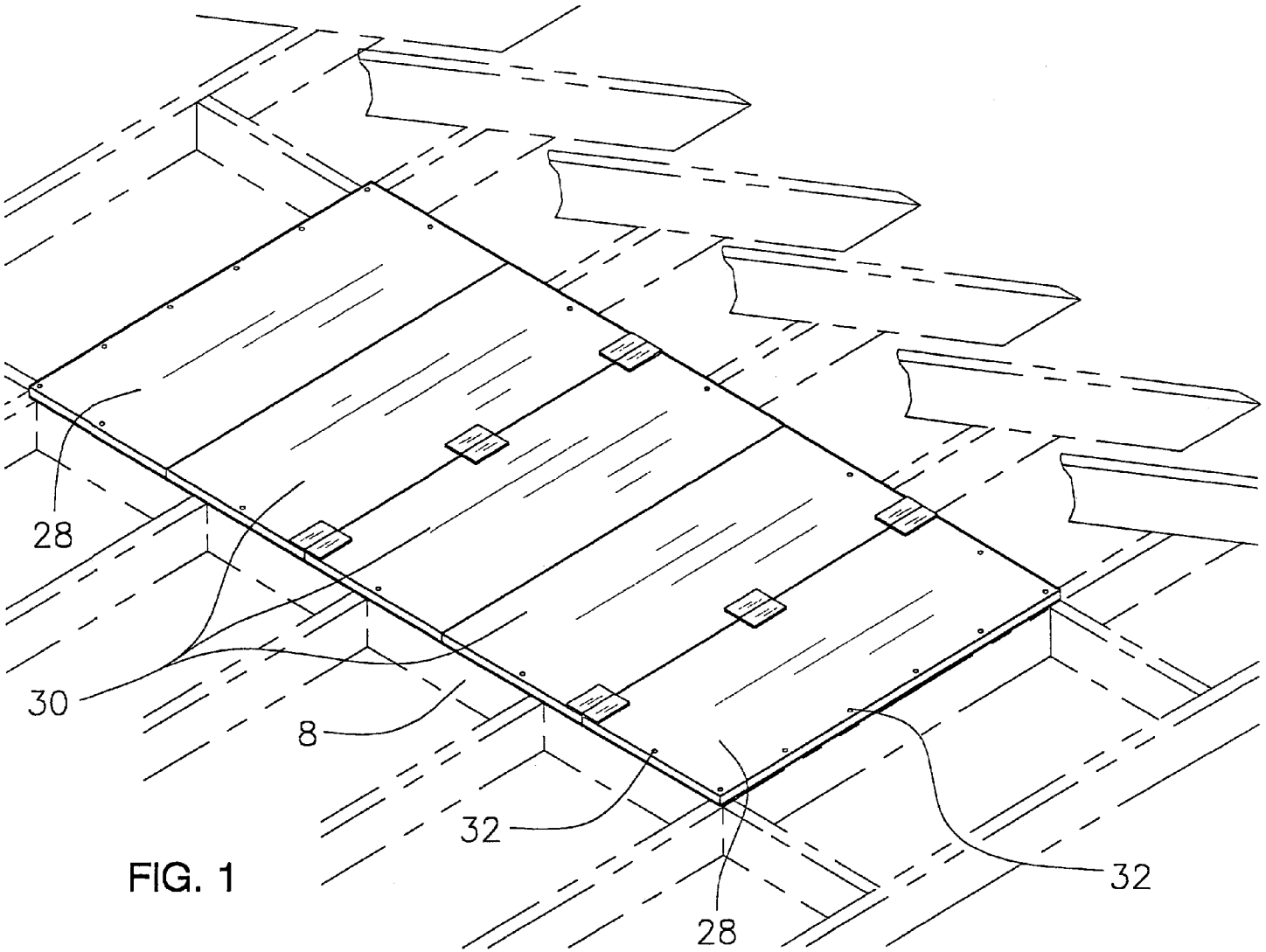
FIG. 1 is a schematic perspective view of a new flooring device for positioning on joists according to the present invention.
Figure 2:
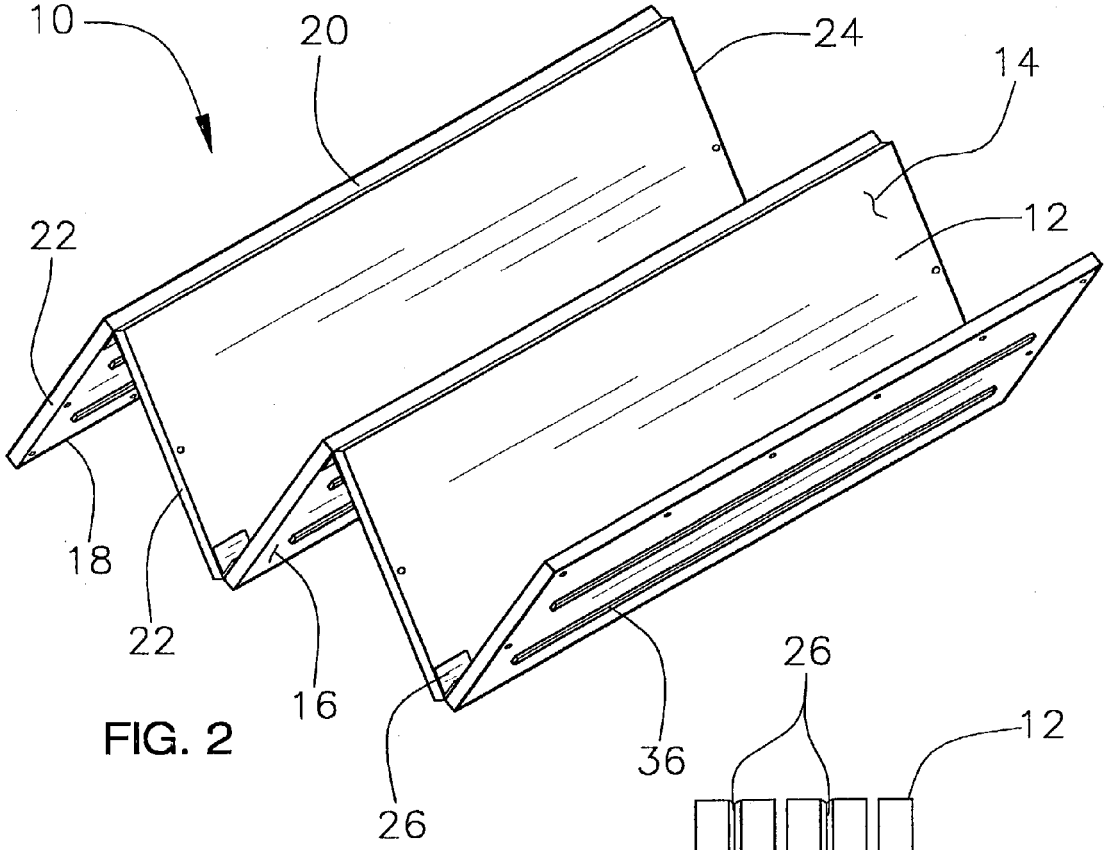
FIG. 2 is a schematic perspective view of the present invention.
Figure 3:
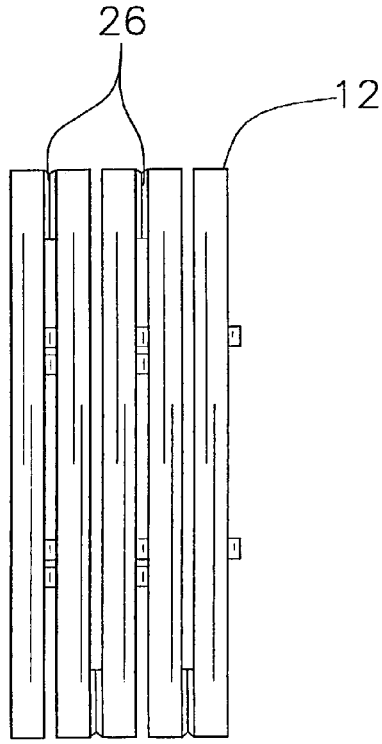
FIG. 3 is a schematic side view of the present invention in the folded position.
Figure 4:
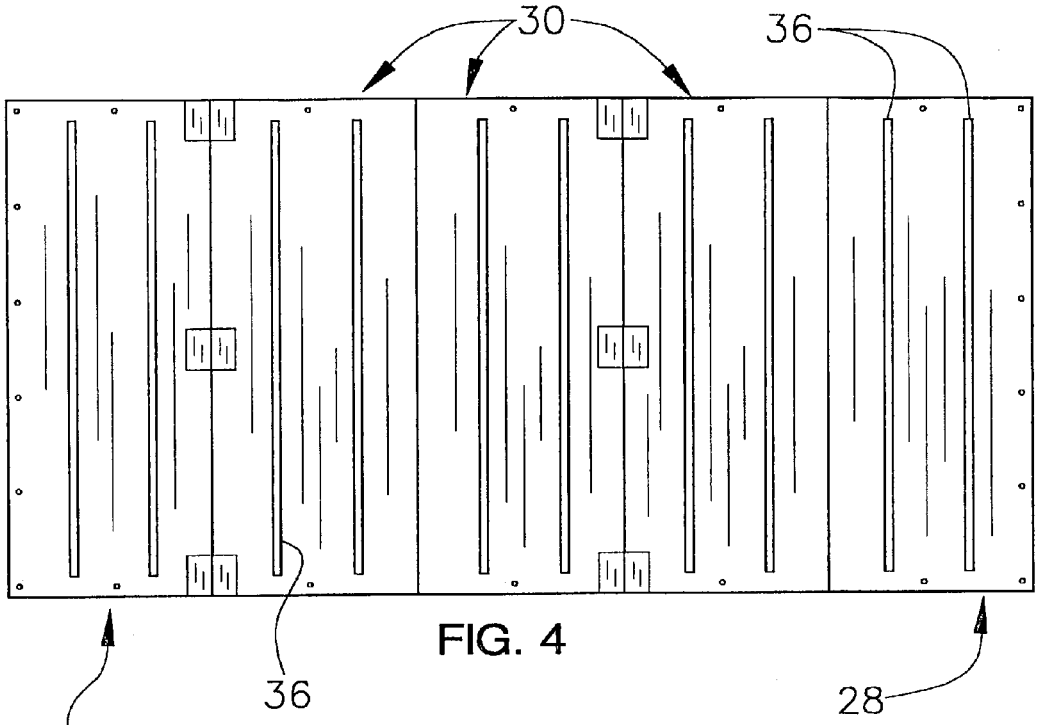
FIG. 4 is a schematic bottom view of the present invention.
Figure 5:
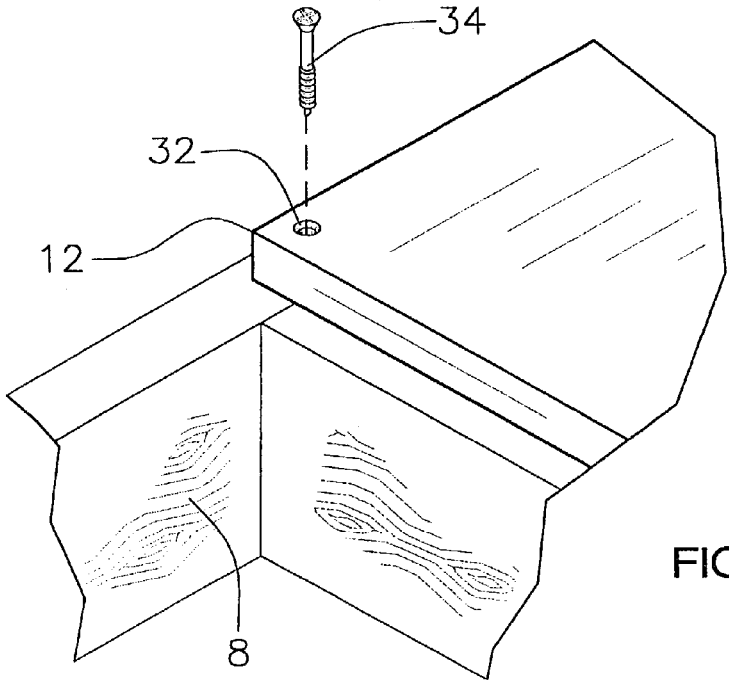
FIG. 5 is a schematic perspective view of the present invention.

With reference now to the drawings, and in particular to FIGS. 1 through 5 thereof, a new flooring device for positioning on joists embodying the principles and concepts of the present invention and generally designated by the reference numeral 10 will be described.

As best illustrated in FIGS. 1 through 5, the flooring device 10 for positioning on joists generally comprises a plurality of rigid panels 12 each having a top side 14, a bottom side 16, a first edge 18, a second edge 20, a third edge 22 and a fourth edge 24. The first 18 and second 20 edges are side edges positioned at opposite locations on the panel, and the third 22 and fourth 24 edges are end edges positioned at opposite locations on the panel. The first 18 and second 20 edges may have a length of approximately 4 feet, and the third 22 and fourth 24 edges may have a length of approximately 2 feet.

Each of the panels 12 is coupled to at least one other panel by at least one hinge 26. Thus, a first edge 18 of one panel 12 may be hingedly coupled to a second edge 20 of an adjacent panel 12 to define a series of panels 12 having a pair of outer panels 28 and at least one inner panel 30, and optionally a plurality of inner panels 30. The series of panels 12 is foldable and unfoldable in an accordion fashion.

Each of the panels 12 may have a plurality of apertures 32 formed therein and extending between the top and bottom sides. The apertures 32 may be positioned along the third 22 and fourth 24 end edges of each of the inner panels 30, and an outer (side) edge of each of the outer panels 28. Fasteners 34 may be extended through the apertures 32 and into floor joists 8 in an attic.

Each of the panels 12 preferably comprises a plastic material, although other materials may be used.

A plurality of rigid elongate members 36 reinforces the panels 12. Each of the elongate members 36 is attached to one of the bottom sides 16 of the panels 12 such that at least two of the elongated members 36 are attached to each of the panels 12. Each of the elongate members 36 has a length preferably between 3 feet and 3½ feet. Each of the elongate members 36 is orientated parallel to the first 18 and second 20 edges.

In use, the panels of the apparatus may be positioned in or folded into a collapsed condition, and the apparatus may be moved in the collapsed condition from the living space through the access opening (even if the access opening has a relatively limited size that only permits a person to move therethrough) and into the attic. The apparatus may then be unfolded into the extended condition in the attic, and the panels of the unfolded apparatus may be rested on the exposed joists. If included on the panels, the elongate reinforcing members may be positioned between the joists so as not to interfere with the firm and stable resting of the bottom surfaces of the panels on the joists. Optionally, the panels may be attached to the joists by passing fasteners through apertures formed in the panels and passing the fasteners into the joists.

The device 10 thus can function as permanent or temporary flooring in the attic space to thereby facilitate movement in the attic space and increase useable storage space while minimizing the danger of stepping through the ceiling of the living space below the attic.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A floor apparatus for forming a floor over exposed joists in an attic, the apparatus comprising:

a plurality of substantially rigid panels arranged adjacent to each other in a series, each of the panels having a top side, a bottom side, a pair of relatively shorter and opposite end edges and a pair of relatively longer and opposite side edges; and connecting means located at a juncture between each of the panels in the series for connecting each panel of the plurality of panels to an adjacent panel in the series, the connecting means permitting adjacent panels of the series to pivot about a pivot axis with respect to each other;

wherein the pivot axis of the connecting means at a first juncture of the series of panels is positioned adjacent to the top sides of the panel adjacent to the first juncture such that the panels adjacent to the first juncture are pivotable to bring the top sides of the adjacent panels together but incapable of pivoting to bring the bottom sides of the adjacent panels together;

wherein the pivot axis of the connecting means at a second juncture adjacent to the first juncture is positioned adjacent to the bottom side of the panels adjacent to the second juncture such that the panels adjacent to the second juncture are pivotable to bring the bottom sides of the adjacent panels together but incapable of pivoting to bring the top sides of the adjacent panels together;

wherein the series of panels are foldable in accordion fashion between a collapsed condition and an extended condition;

wherein each of the panels has at least one aperture formed therein and extending therethrough between the top and bottom sides, the apertures of the panels being adapted for receiving fasteners through the apertures such that the fasteners are engageable to the floor joists; and wherein a plurality of apertures extends along the end edges of each of the inner panels and along at least one outer edge of the outer panels.

2. The apparatus of claim 1 wherein each of the panels comprises a plastic material.

3. The apparatus of claim 1 wherein the side edges of the panels have a length of approximately 4 feet and the end edges of the panels have a length of approximately 2 feet.

4. A floor apparatus for forming a floor over exposed joists in an attic, the apparatus comprising a plurality of substantially rigid panels arranged adjacent to each other in a series, each of the panels having a top side, a bottom side, a pair of relatively shorter and opposite end edges and a pair of relatively longer and opposite side edges;

connecting means located at a juncture between each of the panels in the series for connecting each panel of the plurality of panels to an adjacent panel in the series, the connecting means permitting adjacent panels of the series to pivot about a pivot axis with respect to each other, the pivot axis of the connecting means at one juncture of the series of panels being positioned adjacent to the top sides of the panel adjacent to the juncture and the pivot axis of the connecting means at an adjacent juncture being positioned adjacent to the bottom side of the panels adjacent to the juncture such that the series of panels are foldable in accordion fashion between a collapsed condition and an extended condition; and a plurality of rigid elongate members to reinforce the panels, each of the elongate members being mounted on the bottom sides of each of the panels.

5. The apparatus of claim 4 wherein at least two of the elongated members are attached to each of the panels.

6. The apparatus of claim 4 wherein each of the elongate members is oriented substantially parallel to the side edges of the panel.

7. The apparatus of claim 4 wherein each of the rigid elongate members is mounted on a central portion of each panel.

8. The apparatus of claim 4 wherein opposite ends of the rigid elongate member are in spaced relationship to the end edges of the panel such that the rigid elongate member is positionable between the joists when edge portions of the panels are rested flush on the joists.

9. The apparatus of claim 4 wherein each of the rigid elongate members has a length, the length of each of the elongate members being generally between 3 feet and 3½ feet.

10. A floor apparatus for forming a floor over exposed joists in an attic, the apparatus comprising:

a plurality of substantially rigid panels arranged adjacent to each other in a series, each of the panels having a top side, a bottom side, a pair of relatively shorter and opposite end edges, and a pair of relatively longer and opposite side edges;

connecting means located at a juncture between each of the panels in the series for connecting each panel of the plurality of panels to an adjacent panel in the series, the connecting means permitting adjacent panels of the series to pivot about a pivot axis with respect to each other, the pivot axis of the connecting means at one juncture of the series of panels being positioned adjacent to the top sides of the panel adjacent to the juncture and the pivot axis of the connecting means at an adjacent juncture being positioned adjacent to the bottom side of the panels adjacent to the juncture such that the series of panels are foldable in accordion fashion between a collapsed condition and an extended condition;

wherein the connecting means at each juncture comprises at least one hinge connecting the adjacent panels to each other;

wherein each of the panels has at least one aperture formed therein and extending therethrough between the top and bottom sides, the apertures extending along the end edges of each of the inner panels and along at least one outer edge of the outer panels, each of the apertures of the panels being adapted for receiving fasteners through the apertures such that the fasteners are engageable to the floor joists;

wherein each of the panels comprises a plastic material;

a plurality of rigid elongate members to reinforce the panels, each of the elongate members being mounted on the bottom sides of each of the panels;

wherein at least two of the elongated members are attached to each of the panels;

wherein each of the elongate members is oriented substantially parallel to the side edges of the panel;

wherein each of the rigid elongate members is mounted on a central portion of each panel;

wherein opposite ends of the rigid elongate member are in spaced relationship to the end edges of the panel such that the rigid elongate member is positionable between the joists when edge portions of the panels are rested flush on the joists;

wherein each of the rigid elongate members has a length, the length of each of the elongate members being generally between 3 feet and 3½ feet;

wherein the side edges of the panels have a length of approximately 4 feet and the end edges of the panels have a length of approximately 2 feet.

* * * * *